United States Patent [19]

Sawaki et al.

[11] Patent Number: 4,840,762

[45] Date of Patent: Jun. 20, 1989

[54] PROCESS FOR PREPARATION OF HIGH-PERFORMANCE GRADE CARBON FIBERS

[75] Inventors: Toru Sawaki; Hideharu Sasaki, both of Iwakuni; Tsutomu Nakamura, Kuga; Jiro Sadanobu, Iwakuni, all of Japan

[73] Assignee: Teijin Ltd., Osaka, Japan

[21] Appl. No.: 790,102

[22] Filed: Oct. 22, 1985

Related U.S. Application Data

[63] Continuation-in-part of Ser. No. 690,624, Jan. 11, 1985, abandoned.

[30] Foreign Application Priority Data

| | | | |
|---|---|---|---|
| Jan. 24, 1984 | [JP] | Japan | 59-9454 |
| Jul. 31, 1985 | [JP] | Japan | 60-167466 |
| Jul. 31, 1985 | [JP] | Japan | 60-167467 |

[51] Int. Cl.[4] ..... D01F 9/14

[52] U.S. Cl. ..... 264/29.2; 264/83; 264/130; 264/131; 264/211.15; 264/211.11; 423/447.5; 427/427; 427/434.6

[58] Field of Search ..... 264/29.2, 131, 29.6, 264/29.7, 130, 136, 211.1, 211.15; 423/447.4, 447.6, 447.2, 447.5; 427/427, 434.6

[56] References Cited

U.S. PATENT DOCUMENTS

| | | | |
|---|---|---|---|
| 3,269,802 | 8/1966 | Wainer et al. | 264/29.2 |
| 3,281,261 | 10/1966 | Lynch | 264/29.2 |
| 3,529,934 | 9/1970 | Shindo | 23/209.1 |
| 3,997,645 | 12/1976 | Dempster | 264/163 |
| 4,005,183 | 1/1977 | Singer | 423/447.2 |
| 4,112,059 | 9/1970 | DiEdwardo et al. | 264/29.2 |
| 4,184,942 | 1/1980 | Angier et al. | 423/447.1 |
| 4,275,051 | 6/1981 | Ban | 423/447.4 |
| 4,276,278 | 6/1981 | Ban et al. | 264/29.2 |
| 4,472,265 | 9/1984 | Otani | 423/447.1 |
| 4,496,631 | 1/1985 | Adachi et al. | 264/29.2 |
| 4,582,662 | 4/1986 | Koga et al. | 264/29.2 |

FOREIGN PATENT DOCUMENTS

| | | |
|---|---|---|
| 58-18421 | 2/1983 | Japan . |
| 2129825 | 5/1984 | United Kingdom . |
| 2129825 | 5/1984 | United Kingdom . |

*Primary Examiner*—Hubert Lorin

*Attorney, Agent, or Firm*—Kenyon & Kenyon

[57] ABSTRACT

A process for the preparation of high-performance grade carbon fibers, which comprises attaching a fine powder of at least one member selected from oxides and carbides of silicon, aluminum, titanium, and boron to a precursor fiber bundle of as spun pitch fibers, subjecting the fiber bundle to an infusibilization treatment, and subjecting the fiber bundle to a carbonization treatment.

8 Claims, No Drawings

PROCESS FOR PREPARATION OF HIGH-PERFORMANCE GRADE CARBON FIBERS

CROSS-REFERENCE TO RELATED APPLICATIONS

This is a continuation-in-part of application Ser. No. 690,624, filed on Jan. 11, 1985, now abandoned.

BACKGROUND OF THE INVENTION (1) Field of the Invention

The present invention relates to a process for the preparation of high-performance grade carbon fibers. More particularly, the present invention relates to an improved process for preparing high strength, high-modulus carbon fibers by subjecting a bundle of fibers of a carbon fiber precursor to infusibilization (or thermosetting) and carbonization treatments.

(2) Description of the Related Art

Primarily, carbon fibers were prepared from rayon as the starting material. Then various starting materials and preparation processes were investigated and developed. At present, however, in view of the properties of the products and also from an economical viewpoint, carbon fibers are substantially limited to polyacrylonitrile (PAN) type carbon fibers prepared from polyacrylonitrile and pitch type carbon fibers prepared from a coal or petroleum pitch.

Usually, pitch type carbon fibers have a low strength or modulus, and therefore, they are used as general-purpose grade carbon fibers in the fields of construction materials, heat-insulating materials, and packings. In contrast, PAN type carbon fibers have a high strength and a high modulus, and therefore, most high-performance grade carbon fibers are PAN type carbon fibers.

Recently, however, increasing interest has been shown in the technique of preparing high-performance grade carbon fibers from pitch For example, there have been proposed (a) a process in which pitch fibers obtained by melt-spinning a meso-phase pitch are subjected to an infusibilization treatment in an oxidative atmosphere at an elevated temperature and the fibers are then subjected to a carbonization treatment in an inert gas atmosphere at a higher temperature to obtain high-strength high-modulus carbon fibers (see Japanese Unexamined Patent Publication (Kokai) No. 49-19127, No. 53-65425 and No. 53-119326), (b) a process in which neomeso-phase pitch or dormant meso-phase pitch that can be easily converted to a meso-phase at the spinning step is spun and subjected to infusibilization and carbonization treatments (see v 15 Japanese Unexamined Patent Publication (Kokai) No. 55-58287 and No. 57-100186), and (c) a process in which a premeso-phase pitch that is converted to a meso-phase at the carbonization step is used (see Japanese Unexamined Patent Publication (Kokai) No. 58-18421).

In each of the foregoing processes for preparing high-performance grade carbon fibers, defects caused during the infusibilization treatment result in a drastic degradation of the strength in carbon fibers.

More specifically, at the infusibilization treatment step, various reactions are caused by heating precursor fibers in an oxidative atmosphere at a relatively high temperature close to the melting point or decomposition point of the fibers, whereby the fibers are converted to fibers having no melting point and capable of resisting the subsequent carbonization treatment. Where a multifilament bundle has poor separability, fibers are fused or softened before the fibers are rendered infusible, and fusion bonding occurs among the fibers. The multifilament bundle is hardened and made brittle by this fusion bonding, and thus the formation of fluffs or yarn breakage occurs at the carbonization step and the strength and elongation of the bundle as a whole are reduced Furthermore, surface defects are formed in the fusion-bonded portions of single fibers, resulting in a reduction of the strength, and these defects inhibit any manifestation of a high strength.

As means for eliminating this fusion bonding during the infusibilization treatment, there have been proposed and practiced (a) a method in which coal dust is sprayed onto the filaments before the infusibilization treatment (USSR Patent No. 168,848), (b) a method in which an active carbon powder impregnated with an oxidant is sprayed onto the filaments (U.S. Pat. No. 3,997,645), and (c) a method in which pitch fibers are treated in a dispersion of graphite or carbon black in water containing a water-soluble oxidant and a water-soluble surface active agent dissolved therein (U.S. Pat. Nos. 4,275,051 and 4,276,278).

In each of these methods, a good lubricating property is produced among the precursor fibers by a carbonaceous fine powder; preventing physical damage to the surfaces of fibers during subsequent treatments and any accumulation of heat at the time of oxidation.

To solve the problem of fusion bonding among fibers during the infusibilization treatment step for forming high-performance grade carbon fibers, the present inventors actually carried out the foregoing methods. As a result, it was found that although the carbonaceous fine powder has an effect of preventing fusion bonding during the infusibilization treatment step, it has a negative effect on the strength and elongation of carbon fibers obtained by the sintering treatment. More specifically, in each of the foregoing methods, fusion bonding among the fibers is prevented, but the strength and elongation of the resulting carbon fibers are lower than those of carbon fibers obtained by performing the infusibilization and carbonization treatments without the application of the fine powder. It is considered that this undesirable phenomenon occurs because the carbonaceous fine powder per se generates defects on the surfaces of fibers during the infusibilization and carbonization steps for some as yet unknown reason.

This phenomenon is observed not only when high-performance grade carbon fibers are prepared from pitch fibers but also when high-performance grade carbon fibers are prepared from polyacrylonitrile fibers.

SUMMARY OF THE INVENTION

It is a primary object of the present invention to provide a process for the preparation of high-performance grade carbon fibers, in which fusion bonding among single fibers of a multifilament bundle is prevented during the infusibilization treatment of precursor fibers and an excellent strength and elongation are manifested in the fibers after the carbonization treatment.

Another object of the present invention is to provide a process for preparing on an industrial scale high-performance grade carbon fibers having an excellent openability and softness as a multi-filament yarn, having a high strength and high elongation with a reduced dispersion of the strength, and especially suitable for use as a reinforcing material.

In accordance with the present invention, the foregoing objects can be attained by a process for the preparation of carbon fibers in which a specific inorganic fine powder is attached to a precursor fiber bundle and the fiber bundle is then subjected to infusibilization and carbonization treatments.

More specifically, in accordance with the present invention, there is provided a process for the preparation of high-performance grade carbon fibers, which comprises attaching a fine powder of at least one member selected from oxides and carbides of silicon, aluminum titanium, and boron to a precursor fiber bundle of as spun pitch fibers, and subjecting the fiber bundle to an infusibilization treatment and then to a carbonization treatment.

DESCRIPTION OF THE PREFERRED EMBODIMENTS

In the process of the present invention, the kind of pitch fibers used is not particularly critical. However, to obtain carbon fiber having a much higher performance, it is preferred that pitch fibers used are obtained by melt-spinning a pitch containing an optically anisotropic component and having a quinoline-insoluble portion content of 1 to 60% by weight, which is formed by heat-treating a coal or petroleum pitch. If the quinoline-insoluble portion content of the pitch to be melt-spun is lower than the above-mentioned range, the physical properties of the carbon fibers obtained are reduced, and if the quinoline-insoluble portion content is higher than the above-mentioned range, the spinning property is reduced, resulting in a reduction of the physical properties. From the results of our research, it was found that, among the pitches to be spun, the premeso-phase pitch disclosed in Japanese Unexamined Patent Publication (Kokai) No. 58-18421 or a pitch proposed by us in U.K. Patent Application No. 2129825A is especially preferred.

A customary melt-spinning method may be adopted for spinning the pitch into fibers in the present invention. However, to obtain the desired high-performance grade carbon fibers, it is preferred that the structure of pitch fibers be controlled by controlling such factors as the spinning temperature and the shear at the spinning step. The preferred spinning conditions and preferred structure of the pitch fibers are described in detail in U.K. Patent Application No. 2128825A.

It is preferred that the size of the precursor fibers be such that the diameter of the single fibers after carbonization is smaller than 15 microns The inorganic fine powder used in the present invention is a fine powder of an oxide or carbide of silicon, aluminum, titanium, or boron. Fine powders of silicon oxide ($SiO_2$), aluminum oxide ($Al_2O_3$), titanium oxide ($TiO_2$), titanium carbide (TiC), and boron carbide (BC) are especially preferred. A fine powder having an average particle size smaller than 1 micron and having a particle size as uniform as possible is preferred, to ensure that the fine powder is uniformly attached to the surfaces of the single fibers and that the effects of the present invention become prominent.

We made various experiments using carbonaceous fine powders customarily used for preventing fusion bonding, and many other inorganic fine powders. It was found that only when the above-mentioned specific fine powder according to the present invention is used is fusion bonding prevented, and the strength and elongation of carbon fibers after the carbonization treatment prominently improved over the strength and elongation attained when a fine powder is not attached. This effect is quite unexpected and surprising. The reason for the attainment of this excellent effect has not been completely elucidated, but it is believed that when a fine powder such as mentioned above is attached to the surfaces of fibers of a precursor fiber bundle, the fine powder acts as a spacer among the fibers and prevents fusion bonding among the single fibers during the infusibilization treatment, and furthermore, during the infusibilization and carbonization steps, the fine powder remains chemically stable and does not exert any chemical action (for example, oxidation) on the fibers. In contrast, a conventional carbonaceous fine powder probably has a chemical action on the precursor fibers or carbon fibers during the infusibilization and carbonization treatments and thus has a negative effect on the strength and elongation of the fibers.

In the present invention, the above-mentioned inorganic fine powders may be used singly or in the form of a mixture of two or more of them.

As means for attaching the fine powder to the precursor fiber bundle, there can be adopted (i) a method in which the fine powder is directly sprayed onto the fiber bundle by using a gas as a dispersion medium, (ii) a method in which a dispersion bath is prepared in advance by dispersing the fine powder in a liquid dispersion medium such as water and the fiber bundle is immersed in the dispersion bath and then dried, and (iii) a method in which the fine powder is dispersed in a liquid dispersion medium such as water and the dispersion is coated on the fiber bundle by a roller or the like, or the dispersion is applied to the fiber bundle by spraying.

Since the strength of the pitch fibers is very low, method (i) is preferred. If methods (ii) and (iii) are adopted, it is necessary to prevent reduction of the separability at the drying step by using a surface active agent or the like. When the inorganic fine powder is directly sprayed onto the fiber bundle by using a gas as the dispersion medium, as in method (i), to ensure that the fine powder is uniformly attached to the fiber bundle, it is preferred that spraying be effected between the spinning and winding operations at melt-spinning process of pitch fibers.

The amount of the inorganic fine powder stuck to the precursor fibers is preferably 0.05 to 5%, especially 0.1 to 3%, by weight based on the weight of the fibers. If the amount attached of the inorganic powder is too small, the effects of the present invention are insufficient, and if the amount of the inorganic powder is too large, it is feared that various problems will arise during the infusibilization and carbonization treatments and during the post treatments. Accordingly, in either case, good results cannot be obtained.

According to another feature of the present invention, the above mentioned inorganic fine powder (A) is applied to the precursor fiber bundle in combination with at least one organic silicone selected from the group consisting of dimethyl silicone, amino-modified silicone, and phenyl-modified silicone (B), and/or at least one alcohol selected from the group consisting of monohydric and polyhydric alcohols having a boiling point of 120° to 300° C. and a melting point of not more than 10° C. (C).

In this process, the inorganic fine powder is used as a dispersion. As the dispersing medium, it is preferred to use one, such as water, which is inert to the precursor pitch fibers and does not aggregate the fine particles of the inorganic fine powder. Further, it is possible to use an emulsifier for the purpose of assisting the dispersion of the fine particles. However, it is desirable to avoid the use of an emulsifier containing a metal.

Preferably, the organic silicone (B) is dimethyl silicone. As the organic silicone, commercially available organic silicone compounds may be used. However, they are preferred to have a low viscosity, desirably of not higher than 500 cst.

For the alcohol (C), there may be exemplified as the monohydric alcohol butanol, pentanol, hexanol and the like, as the dihydric alcohol ethylene glycol, propylene glycol, penta-methylene glycol, diethylene glycol, and the like, and as the trihydric alcohol glycerol, and the like. Among these, ethylene glycol, diethylene glycol, and glycerol are particularly preferred.

The above-mentioned alcohols (C) may be used singly or in the form of a mixture of two or more of them. They may be generally used as a solution. In the solution, iodine may be added in an amount of 0.01 to 0.5% by weight. In this case, the time necessary for the infusibilization can be decreased. The medium for the solution should be inert for pitch and is preferably water. Also, it is possible to use an emulsifier, but it is desirable not to use an emulsifier containing a metal.

The treating agents (A) and (B) and/or (C) should be applied to the precursor fiber bundle in combination sequentially in any order or concurrently in the form of separately prepared liquids. Alternatively, a suspension or solution containing both the treating agents (A) and (B) and/or (C) may be prepared in advance and then applied to the fiber bundle. In this case, the organic silicone (B) or a solution or suspension thereof, and/or the alcohol (C) or a solution thereof may be used as the suspending medium of the inorganic fine powder (A).

The treating agents of the liquids thereof may be applied to the precursor fiber bundle, for example, by (i) using an oiling roll, (ii) applying a treating liquid fed by a metering pump with a ceramic guide, or (iii) using a spray means.

The application of the treating agents to the precursor fiber bundle should be carried out between the spinneret and the take-up means. In order to apply the treating agents to the fragile precursor fiber bundle as spun from the spinneret, the above-mentioned application means (i) or (ii) can preferably be employed. The amount of the inorganic fine powder (A) stuck to the precursor fibers is preferably not less than 0.05% by weight based on the weight of the fibers. If the amount of the inorganic fine powder is too small, the fusion bonding-preventing effect of the present invention is insufficient. The amount of the organic silicone (B) and/or alcohol (C) stuck to the precursor fibers is preferably 0.05 to 20% by weight based on the weight of the fibers. If the amount of the organic silicone or alcohol is too small, it is difficult to stably handle with the precursor fiber bundle, and if the amount is too large, fusion bonding may undesirably occur among the fibers.

The precursor fiber bundle to which the above-mentioned inorganic fine powder alone or the inorganic fine powder and the organic silicone and/or alcohol in combination have been thus attached is rendered, after drying and opening if necessary, infusible by heating in pure oxygen or an oxygen-containing atmosphere such as air according to the conventional method. Then, the thus-infusibilized fibers are carbonized, usually by heating the fibers in an inert atmosphere at 1,000° to 1,500° C., whereby the intended carbon fibers are obtained.

In the present invention, known conditions may be adopted for the infusibilization and carbonization treatments, and no particular care need be taken during the infusibilization and carbonization treatments, even when the inorganic fine powder is attached to the fiber bundle.

As is apparent from the foregoing description, according to the present invention, fusion bonding is substantially prevented among single fibers during the infusibilization treatment of precursor fibers in the production of carbon fibers, and the openability and softness of the carbon fibers are enhanced after the carbonization treatment. Furthermore, and surprisingly, in the carbon fibers prepared according to the present invention, the strength and elongation are much improved over the strength and elongation of carbon fibers obtained by infusibilization and carbonization treatments wherein the fine powder is not attached or by applying a known carbonaceous fine powder, even though the same precursor fibers are used and the same infusibilization and carbonization treatment conditions are adopted. Moreover, the dispersion of the strength among the respective fibers is reduced and the uniformity is improved.

Furthermore, since very little fusion bonding is caused during the infusibilization treatment step, it becomes possible to increase the temperature-elevating rate at the step, and the time necessary for the infusibilization treatment can be shortened as compared with the infusibilization treatment time required in the conventional techniques.

As pointed out hereinbefore, the levels of the strength and elongation of the carbon fibers obtained according to the process of the present invention are very high, the dispersion of the strength is reduced, and an excellent openability and softness are obtained. Accordingly, the carbon fibers obtained according to the present invention are very valuable as high-performance grade carbon fibers and can be used as reinforcers for rubbers, resins, metals, and the like in various fields.

The present invention will now be described in detail with reference to the following examples and comparative examples that by no means limit the scope of the invention.

EXAMPLE 1

According to the process disclosed in Japanese unexamined Patent Publication (Kokai) No. 58-18421, a pitch to be melt-spun, which was optically anisotropic and had a quinoline-insoluble portion content of 38.6% by weight, was prepared by using coal tar pitch.

This pitch to be melt-spun was charged in a metering feeder provided with a heater, and the pitch was melted and bubbles were removed. The resultant melt was then fed into a spinneret through a separately arranged heating zone and was spun. The spinneret was characterized by a hole length (mm)/hole diameter (mm) (L/D) ratio of 0.36/0.18 and a hole number of 50. The heating zone temperature was adjusted to 400° C., the spinneret temperature was adjusted to 350° C., and the extrusion rate in the feeder was adjusted to 0.64 ml/min/hole. The pitch fiber bundle extruded from the spinneret and cooled and solidified was wound at a winding speed of 800 m/min. During this winding operation, the fiber bundle was passed through a zone in which an inorganic fine powder shown in Table 1 was dispersed, whereby a predetermined amount of the inorganic fine powder was attached to the surfaces of the pitch fibers.

The obtained pitch fiber bundle was subjected to an infusibilization treatment at 300° C. in an air current, and was then subjected to carbonization treatment at 1500° C. in a nitrogen current. In the thus-obtained carbon fibers, the fusion bonding among single fibers was checked by the naked eye, and physical properties such as the strength , ($\sigma_b$) elongation ($\epsilon$), and modulus (E) are determined. The results obtained are shown in Table 1.

Note, where an inorganic fine powder was not attached to the surfaces of the fibers (run No. 1), considerable fusion bonding occurred among the single fibers. Accordingly, the non-fusion-bonded portion was taken out, and the strength, elongation, and the like of this portion were determined.

As is apparent from the results shown in Table 1, when an inorganic fine powder specified in the present invention is attached to the surfaces of the fibers (run Nos. 2 through 6), fusion bonding does not occur and the dispersion of the strength is small. Furthermore, if silicon oxide, aluminum oxide, or titanium oxide is used as the inorganic fine powder (run Nos. 2 through 4), both the strength and elongation are improved.

TABLE 1

| | Inorganic Fine Powder | | | Physical Properties of Carbon Fibers | | | | | |
|---|---|---|---|---|---|---|---|---|---|
| Run No. | Kind | Average Particle Size ($\mu$) | Amount attached (%) | Fiber Diameter ($\mu$) | Strength (kg/mm$^2$) | Elongation (%) | Modulus (T/mm$^2$) | Dispersion ($\sigma$x) of Strength | Fusion Bonding (naked eye check) |
| 1. | (blank) | — | — | 8 | 201 | 1.4 | 14.0 | 22 | observed |
| 2. | silicon oxide | 0.007 | 0.7 | 8 | 274 | 1.9 | 14.2 | 8 | not observed |
| 3. | aluminum oxide | 0.3 | 0.9 | 8 | 219 | 1.6 | 13.7 | 6 | not observed |
| 4. | titanium oxide | 0.03 | 0.9 | 8 | 208 | 1.7 | 12.5 | 9 | not observed |
| 5. | boron carbide | 1 | 1.0 | 8 | 191 | 1.5 | 12.8 | 8 | not observed |
| 6. | titanium carbide | 0.3 | 0.9 | 8 | 210 | — | 13.5 | 7 | not observed |

COMPARATIVE EXAMPLE 1

Pitch fibers were spun and wound in the same manner as described in Example 1. At the winding step, a fine powder of talc (magnesium silicate), zinc oxide, or a carbonaceous substance such as active carbon or graphite was attached to the pitch fiber bundle, and the pitch fiber bundle was then subjected to the infusibilization and carbonization treatments in the same manner as described in Example 1.

The fusion bonding state and physical properties of the obtained carbon fibers are shown in Table 2. As is apparent from the results shown in Table 2, if an inorganic fine powder such as mentioned above is used, fusion bonding is prevented and the dispersion of the strength is somewhat reduced. However, the strength and modulus of the obtained carbon fibers are drastically reduced as compared with those of the blank (run No. 1).

TABLE 1

| | Inorganic Fine Powder | | | Physical Properties of Carbon Fibers | | | | | |
|---|---|---|---|---|---|---|---|---|---|
| Run No. | Kind | Average Particle Size ($\mu$) | Amount attached (%) | Fiber Diameter ($\mu$) | Strength (kg/mm$^2$) | Elongation (%) | Modulus (T/mm$^2$) | Dispersion ($\sigma$x) of Strength | Fusion Bonding (naked eye check) |
| 1. | (blank) | — | — | 8 | 201 | 1.4 | 14.0 | 22 | observed |
| 7. | active carbon | 1 | 1.0 | 8 | 156 | 1.7 | 9.1 | 10 | not observed |
| 8. | graphite | 1 | 0.9 | 8 | 140 | 1.4 | 10.2 | 12 | not observed |
| 9. | talc | <1 | 1.0 | 8 | 110 | 1.0 | 10.8 | 15 | not observed |
| 10. | zinc oxide | <1 | 1.0 | 8 | 65 | 0.7 | 9.6 | 15 | not observed |

EXAMPLE 2

A tetrahydrofuran-soluble toluene-insoluble fraction was taken out from coal tar pitch and heat-treated at 440° C. under normal pressure in nitrogen for 10 minutes to obtain a pitch to be melt-spun. This pitch had a quinoline-insoluble portion content of 47% by weight.

In the same manner as described in Example 1, the pitch was melt-spun at an extrusion rate of 0.064 ml/min/hole, a heating zone temperature of 390° C., a spinneret temperature of 360° C., and a winding speed of 800 m/min by using a spinneret having an L/D ratio of 0.36/0.18 and a hole number of 50.

Between the spinning and winding operations, a fine powder of silicon oxide was attached to the spun pitch fiber bundle.

The obtained pitch fiber bundle was subjected to an infusibilization treatment at 300° C. in an air current and then to a carbonization treatment at 1500° C. in a nitrogen current, to obtain carbon fibers having a diameter of 8 $\mu$.

In the thus-obtained carbon fibers, fusion bonding did not occur among the single fibers, and the fibers were pliable and had an excellent openability. The carbon fibers were characterized by a strength ($\sigma_b$) of 253 kg/mm$^2$, an elongation (e) of 1.9%, and a modulus (E) of 13.3 T/mm$^2$.

In contrast, when an inorganic fine powder was not attached to the carbon fiber bundle, fusion bonding was conspicuous among fibers of the carbon fiber bundle and the resulting carbon fiber bundle resembled a rod. The fibers (collected with difficulty) had a strength ($\sigma_b$) of 187 kg/mm$^2$, an elongation ($\epsilon$) of 1.4%, and a modulus (E) of 13.4 T/mm$^2$.

EXAMPLE 3

A fiber bundle (monofilament denier of 1.0 de; strength of 4.1 g/de) obtained by wet-spinning polyacrylonitrile having an acrylonitrile content higher than 99 mole % was immersed in an aqueous dispersion of a fine powder of silicon oxide, and the fiber bundle was squeezed by a squeezing roller so that the amount attached of the silicon oxide fine powder after drying was 1% by weight based on the weight of the fibers.

The temperature of the obtained fiber bundle was gradually elevated in air while adjusting the temperature-elevating rate to 2° C./min in the temperature range of from 200° C. to 300° C., so that the shrinkage factor was lower than 5%. The fiber bundle was maintained at 300° C. for 30 minutes to effect an infusibilization treatment.

The thus-obtained infusible yarn was pliable and had no fusion bonding. The non-fusible yarn was subjected to a carbonization treatment in a nitrogen current at 1300° C. to obtain carbon fibers having a strength ($\sigma_b$) of 340 kg/mm$^2$, an elongation ($\epsilon$) of 1.6%, and a modulus (E) of 21.3 T/mm$^2$. No fusion bonding was observed, and the carbon fibers were pliable.

In contrast, where silicon oxide was not attached to the polyacrylonitrile fiber bundle, fusion bonding had already occurred during the infusibilization treatment, and when the infusible fiber bundle was subjected to the carbonization treatment, fusion bonding was prominent and the obtained product resembled a rod. The fibers (collected with difficulty) had a strength ($\sigma_b$) of 180 Kg/mm$^2$, an elongation ($\epsilon$) of 0.9%, and a modulus (E) of 20.0 T/mm$^2$.

EXAMPLE 4

According to the process disclosed in Japanese Patent Application No. 59-169199, a commercially available coal tar pitch was converted into a pitch for spinning which was substantially fully optically anisotropic and had a quinoline insoluble portion content of 31.4% by weight.

This pitch was melted and bubbles were removed. Then, the melt was extruded from a spinneret having 48 holes through a gear pump, and the spun filaments were taken up at a speed of 800 m/min to obtain a precursor fiber bundle. In this operation, a metering oiling device having two ceramic guides along the yarn-running direction was provided between the spinneret and the take-up means for applying a suspension of a treating agent (A) and a treating agent (B) fed by a metering pump to the yarn, and a 4% aqueous dispersion of silica of an average particle size of 30 millimicrons was applied to the precusor fibers, at the upstream side, as the treating agent (A) in an amount of 1.5% by weight and a 4% aqueous dispersion of dimethyl silicone of a viscosity of 40 cst was applied to the fibers, at the downstream side, as the treating agent (B) in an amount of 1.0% by weight.

The precursor fibers thus taken up were stable to storage .for a several days with no fuzz being produced and could be easily unwound and continuously fed to an infusibilization furnace.

The pitch fiber bundle was infusibilized n the infusibilization furnace set at a maximum temperature of 300° C. under air atmosphere. The infusibilized yarn was flexible and no fusion bonding among the individual fibers was observed. Then, the infusibilized yarn was carbonized under nitrogen atmosphere at 1,300° C. to obtain carbon fibers having a strength of 403 kg/mm$^2$ and an elongation of 1.8%.

EXAMPLE 5

The procedure as in Example 4 was repeated, except that an aqueous dispersion containing 1% of silica of an average particle size of 30 millimicrons and 1% of dimethyl silicone was applied to the precursor fiber bundle, as a mixture of the treating agents (A) and (B), using a metering oiling device provided between the spinneret and the take up device.

The obtained precursor fiber bundle could be easily unwound, and the infusibilized yarns was flexible and no fusion bonding among the individual fibers was observed. The obtained carbon fibers had a strength of 389 kg/mm$^2$.

EXAMPLE 6

According to the process disclosed in Japanese Patent Application No. 59-169199, a commercially available coal tar pitch was converted into a pitch for spinning which was substantially fully optically anisotropic and had a quinoline-insoluble portion content of 31.4% by weight.

This pitch was melted and bubbles were removed. Then, the melt was extruded from a spinneret having 48 holes through a gear pump, and the spun filaments were taken up at a speed of 800 m/min to obtain a precursor fiber bundle. In this operation, a metering oiling device having two ceramic guides along the yarn-running direction was provided between the spinneret and the take-up means for applying a suspension of a treating agent (A) and a treating agent (C) fed by a metering pump to the yarn, and a 4% aqueous dispersion of silica of an average particle size of 30 millimicrons was applied to the precusor fibers, at the upstream side, as the treating agent (A) in an amount of 1.5% by weight and a 4% aqueous solution of ethylene glycol was applied to the fibers, at the downstream side, as the treating agent (C) in an amount of 1.0% by weight.

The precursor fibers thus taken up were stable to storage for a several days with no fuzz being produced, and could be easily unwound and continuously fed to an infusibilization furnace.

The pitch fiber bundle was infusibilized in the infusibilization furnace set at a maximum temperature of 300° C. under air atmosphere. The infusibilized yarn was flexible and no fusion bonding among the individual fibers was observed. Then, the infusibilized yarn was carbonized under nitrogen atmosphere at 1,300° C. to obtain carbon fibers having a strength of 415 kg/mm$^2$ and an elongation of 1.82%.

EXAMPLE 7

The procedure as in Example 6 was repeated, except that an aqueous dispersion containing 2% of silica of an average particle size of 30 millimicrons and 4% of ethylene glycol was applied to the precursor fiber bundle, as a mixture of the treating agents (A) and (C), using a metering oiling device provided between the spinnert and the take-up device.

The obtained precursor fiber bundle could be easily unwound, and the infusibilized yarns was flexible and no fusion bonding among the individual fibers was observed. The obtained carbon fibers had a strength of 399 kg/mm$^2$.

We claim:

1. A process for the preparation of high-performance grade carbon fibers, which process comprises attaching a fine powder of at least one member selected from the group consisting of oxides and carbides of silicon, aluminum, titanium, and boron to a precursor fiber bundle of as-spun pitch fibers, subjecting the fiber bundle to an infusibilization treatment, and subjecting the fiber bundle to a carbonization treatment, wherein the fine powder is attached to the precursor fiber bundle in an amount of 0.1 to 3% by weight based on the weight of the fibers, such that fusion bonding of the fibers in the bundle during infusibilization is substantially prevented without degrading the strength and elongation characteristics of the resulting carbon fibers.

2. A process according to claim 1, wherein the fine powder is selected from the group consisting of silicon oxide, aluminum oxide, titanium oxide, titanium carbide and boron carbide.

3. A process according to claim 1, wherein the fine powder has an average particle size smaller than 1 micron.

4. A process according to claim 1, wherein the fine powder is attached to the precursor fiber bundle by directly spraying the fine powder onto the fiber bundle using a gas as a dispersion medium.

5. A process according to claim 1, wherein the fine powder is attached to the precursor fiber bundle by immersing the fiber bundle in a dispersion bath in which the fine powder is dispersed in a liquid dispersion medium.

6. A process according to claim I, wherein the fine powder is attached to the precursor fiber bundle by coating the fiber bundle with a dispersion in which the fine powder is dispersed in a liquid dispersion medium.

7. A process according to claim 1, wherein the precursor fibers have a size such that the diameter of single fibers after carbonization is smaller than 15 microns.

8. A process according to claim 1, wherein the precursor fiber bundle is a pitch fiber bundle melt-spun from a pitch containing an optically anisotropic component and having a quinoline-insoluble portion content of 1 to 60% by weight.

* * * * *